United States Patent [19]

Millman

[11] Patent Number: 4,702,048

[45] Date of Patent: Oct. 27, 1987

[54] BUBBLE RELIEF FORM FOR CONCRETE

[76] Inventor: Paul Millman, 201 W. 70th St., New York, N.Y. 10023

[21] Appl. No.: 597,366

[22] Filed: Apr. 6, 1984

[51] Int. Cl.[4] ..... E04B 5/38

[52] U.S. Cl. ..... 52/169.5; 52/169.11; 52/454; 52/577; 52/687; 249/2; 249/13; 249/189

[58] Field of Search ..... 249/140, 1, 2, 10, 13, 249/31, 32, 127, 176, 189; 52/576, 577, 169.1, 169.11, 630, 687, 454, 169.5; 405/229

[56] References Cited

U.S. PATENT DOCUMENTS

| | | | |
|---|---|---|---|
| 495,872 | 4/1893 | Ball | 249/140 |
| 534,633 | 2/1895 | Coleman | 249/127 |
| 1,525,172 | 2/1925 | Eberhard | 249/176 |
| 1,580,485 | 4/1926 | Rice | 249/31 |
| 2,653,525 | 9/1953 | McGuire | 52/577 |
| 3,802,147 | 4/1974 | O'Konski | 52/454 |
| 3,892,902 | 7/1975 | Ilukowicz | 52/98 |
| 3,967,747 | 7/1976 | Wagner | 206/519 |
| 4,426,002 | 1/1984 | Rez | 249/127 |

FOREIGN PATENT DOCUMENTS

| | | | |
|---|---|---|---|
| 1286730 | 1/1969 | Fed. Rep. of Germany . | |
| 1299840 | 7/1969 | Fed. Rep. of Germany | 52/577 |
| 1122462 | 9/1956 | France | 52/576 |
| 1213565 | 11/1959 | France | 52/576 |
| 35707 | 6/1949 | Poland | 52/577 |

*Primary Examiner*—Jay H. Woo
*Assistant Examiner*—James C. Housel
*Attorney, Agent, or Firm*—Natter & Natter

[57] ABSTRACT

A rigid, light-weight, thermoplastic bubble insulation form for cast in situ concrete slabs includes hemispherical void spaces for reduction of concrete volume and thermal insulation characteristics. An upper hemispheric surface provides an integral seating arrangement for wire mesh reinforcement. An under-surface of the form includes spacer nodules for facilitating drainage. The bubble relief form is water impervious for controlling curing of the concrete and further is supplied in modular units adapted for trimming and overlapping spliced connections.

6 Claims, 6 Drawing Figures

FIG. 1
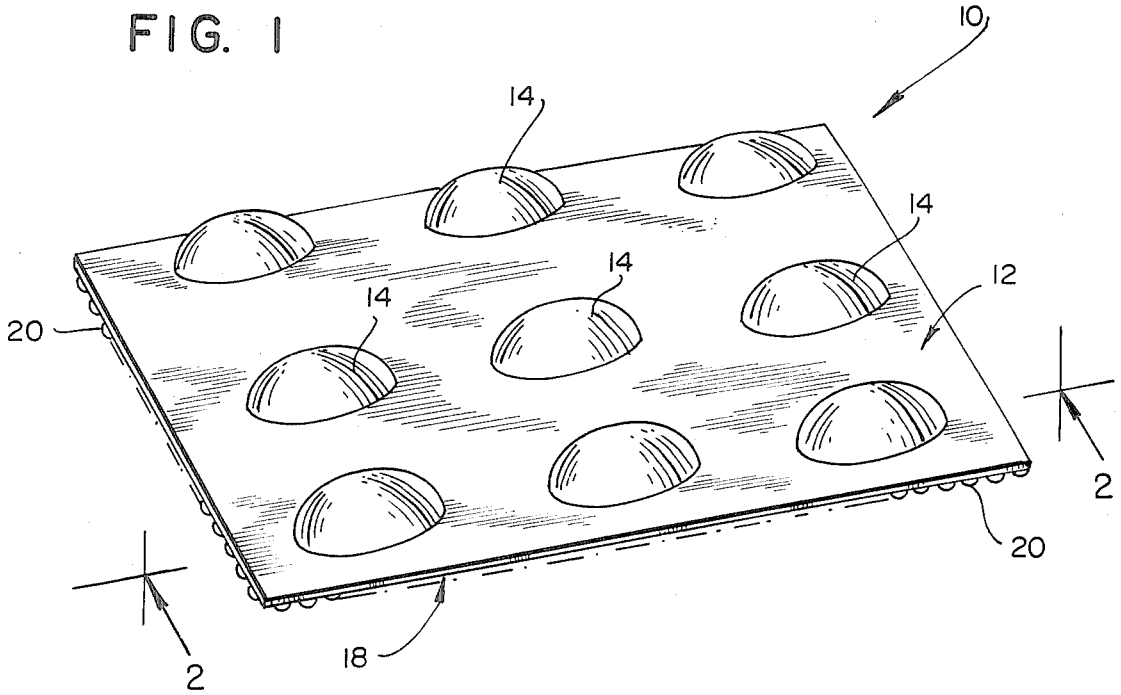
FIG. 2
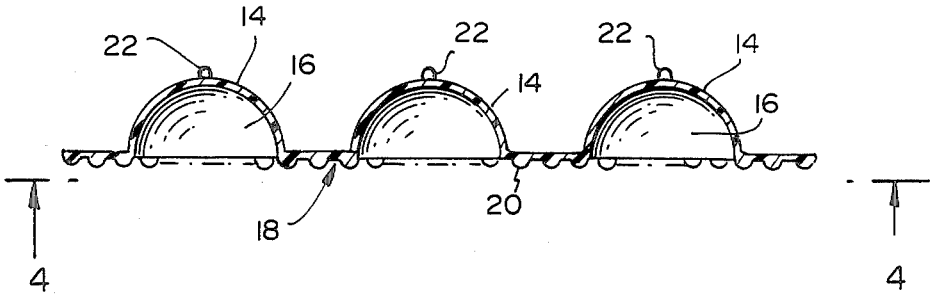
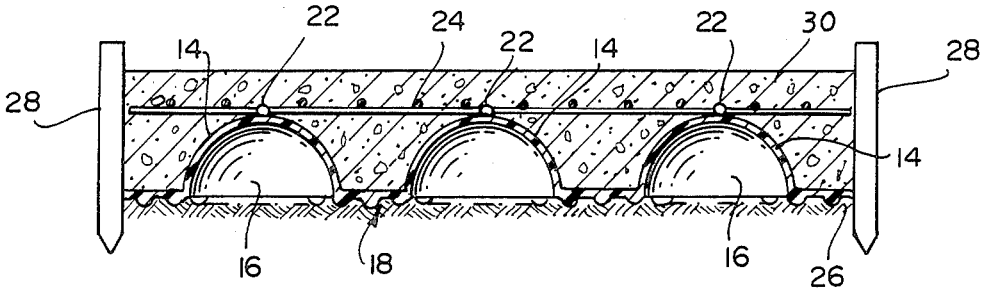
FIG. 3

FIG. 4
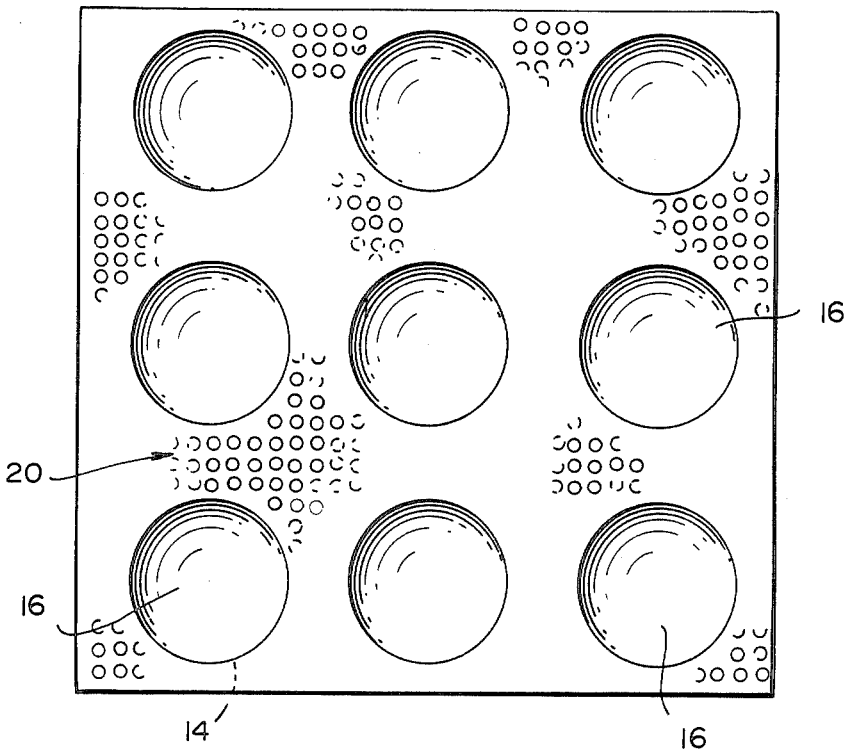
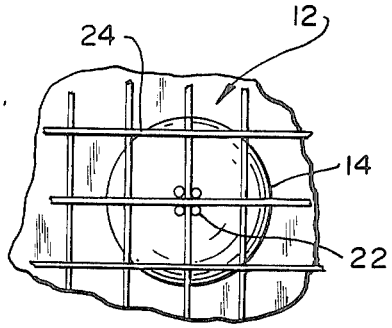
FIG. 5
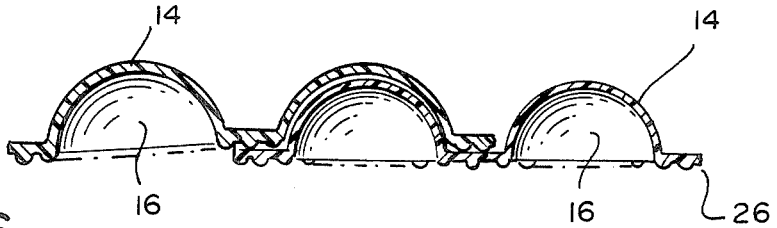
FIG. 6

BUBBLE RELIEF FORM FOR CONCRETE

TECHNICAL FIELD

This invention relates generally to static structures, and especially to an improvement in cast-in-place concrete construction.

In particular, the device of this invention concerns a bubble relief form adapted for incorporation into the finished concrete.

BACKGROUND ART

Concrete construction methods conventionally utilized forms for the placement, finishing and curing of concrete. The application of those forms to foundation structures, such as slabs, mats, footings and to pavements, usually required considerable preparation of the subgrade for providing a support surface for static and/or dynamic loading conditions. That frequently necessitated the compaction of the underlying soil and/or fill material, placement of successive layers of sand, crushed stone and gravel for distributing the superimposed loads and for drainage purposes. Also, the prepared base had to be moistened to reduce the absorption of water from the freshly poured concrete. Alternate steps included providing a vapor barrier which was usually in the form of a polyethylene sheet placed directly on the prepared base and the installation of side forms or "headers" to define the perimeter of the structure. That construction procedure further required the setting of reinforcing steel, usually in the form of wire mesh or wire fabric, to preserve aggregate interlock and prevent surface cracks. That reinforcement was placed upon chairs which were designed to support the reinforcement at a desired location below the finished grade of the concrete. The concrete, in a plastic state, was then deposited within that form arrangement and, after curing, the form had to be stripped.

A problem with seating wire fabric, as described above, was that when the concrete was poured, the wire mesh tended to drape and, therefore, it was difficult to keep the reinforcement at a constant design depth below the finished grade.

A further shortcoming of those construction methods was that the forms did not provide an optimum distribution of concrete but, rather, relied upon a uniform maximum thickness throughout even though not structurally required for withstanding compressive stresses under actual load conditions. Other attempts to modify concrete sections, so as to reduce the volume of concrete, appeared in structural members incorporated into floor systems, such as metal-pan, cellular and corrugated steel forms.

Reference is also made to the above ground floor slabs illustrated in U.S. Pat. No. 3,334,458. The relief form of this invention in contrast is adapted primarily to accommodate the concrete on grade and conforming to the configuration of the form rather than to function as an integral structural member.

Another disadvantage was that the multistep procedure of the prior art was not cost effective with regard to materials, time and labor.

DISCLOSURE OF THE INVENTION

Briefly, the nature of this invention involves a mold for receiving concrete in a plastic state. A base member is designed for substantially horizontal placement upon a subgrade and includes a relief matrix for minimizing the volume of concrete. The relief matrix is preferably formed as hemispherical convexities defining void spaces thereunder forming air insulation pockets when the under-surface of the base member is in confronting relationship with the subgrade.

The base member of this exemplary embodiment is constructed of a rigid, light-weight, thermoplastic material which is impervious to water so as to obviate the need for an independent moisture barrier. The base member is intended to remain in place as an integral element in the completed concrete and is not stripped after curing.

The upper surface of the convexities provides a support network for seating a wire mesh reinforcement at a constant depth within the concrete and includes tab members for snugably engaging the wire mesh reinforcement.

The under-surface of the base member is provided with projections or spacer nodules arranged so as to provide a clearance between the base member and the subgrade thus facilitating drainage. These so formed passages eliminate the need for a graded gravel layer or under-drains as previously employed.

A further aspect of this invention is that the dome-shaped void spaces and drainage passageways concomitantly provide areas for relieving hydrostatic pressure, localized frost heave and other uplift forces.

Another feature of the invention is that the total volume of concrete is reduced and the resultant deadweight of the concrete slab is decreased to thus alleviate the tendency of the support surface to settle as a result of consolidation from the overlying weight.

In view of the foregoing, it should be apparent that the present invention overcomes many of the disadvantages of the prior art and provides an improved bubble relief form for concrete construction which is readily adapted to meet applications of practical use.

Having thus summarized the invention, it will be seen that it is an object thereof to provide a bubble relief form for concrete construction of the general character described herein.

Specifically, it is an object of the present invention to provide a bubble relief form which is integrated into the concrete structure and provides a stratum between the concrete and the supporting subgrade.

Another object of this invention is to provide a bubble relief form which functions as a vapor barrier for preventing dissipation of moisture during curing of the concrete.

Still another object of this invention is to provide a bubble relief form which incorporates a plurality of air pockets for providing insulation and reducing the volume of concrete required.

Yet another object of this invention is to provide a bubble relief form for concrete construction with self-contained drainage provisions.

A still further object of this invention is to provide a bubble relief form including a support system for facilitating the positioning and placement of reinforcement within the concrete.

An additional object of this invention is to provide a bubble relief form for concrete construction which is simple in construction, low in cost and reliable in use.

Other objects, features and advantages of the invention will in part be obvious and will in part be pointed out hereinafter.

With these ends in view, the invention finds embodiment in certain combinations of elements and arrangements of parts by which the objects aforementioned and certain other objects are hereinafter attained, all as more fully described with reference to the accompanying drawings and a scope of which is more particularly pointed out in the appended claims.

BRIEF DESCRIPTION OF THE DRAWINGS

In the accompanying drawings in which are shown possible exemplary embodiments of the invention:

FIG. 1 is a perspective view of a bubble relief form for concrete construction in accordance with this invention showing a typical modular base section;

FIG. 2 is a sectional view taken substantially along line 2—2 of FIG. 1 showing the base member and a series of bubbles defining dome-shaped voids, a seating tab for the reinforcement mesh and a nodulated under-surface portion;

FIG. 3 is a sectional view similar to that shown in FIG. 2 after placement of the concrete, and further illustrating side forms defining a perimeter boundary, reinforcement mesh seated on the convex bubble surfaces with the nodulated surface confronting a supporting subgrade;

FIG. 4 is a plan of the bubble relief form as viewed from the under surface of the base member showing the spacial relationship between the dome-shaped voids and the nodulated surface;

FIG. 5 is an isolated plan view of a section of the base member and the bubble detailing the reinforcement mesh engagement with the seating tab; and FIG. 6 is a sectional view showing two segments of the bubble relief form of this invention demonstrating an overlapping interconnection.

BEST MODE FOR CARRYING OUT THE INVENTION

Referring now in detail to the drawings, the reference numeral 10 denotes generally a bubble relief form for concrete construction in accordance with this invention.

The relief form 10, shown in FIG. 1, includes a substantially planar base 12 having a plurality of uniformly spaced convexities 14 which, for the purpose of this invention, are typically shown as being hemispherical bubbles. It should be understood, however, that the relief areas of the base 12 can assume other shapes or configurations. The preferred curvature, as illustrated herein, provides a dome-shaped enclosure or void space 16. In addition, the under-surface 18 of the base 12 is provided with a pattern of spacer nodules 20. A pair of tabs 22 are provided on the convex relief surfaces 14 with each of the tabs 22 lying within a horizontal plane being substantially tangent to the convexities 14. Furthermore, the tabs 22 are preferably arranged in sets of four, as shown in FIG. 5, and are adapted for engaging a reinforcement wire mesh 24.

It should be noted that the bubble relief form 10 is preferably constructed from a light-weight, rigid, thermoplastic material, which can be stamped, vacuum formed or otherwise molded in sheets providing the base member 12 with typical dimensions of 4 ft. by 8 ft. (1.2 meters by 2.4 meters). Additionally, the base members 12 are adapted for nestable stacking for compact storage and shipment; the light-weight and size further permit convenient handling. Additionally, the base members 12 can be trimmed or spliced in an overlapping connection for special conditions. The splicing can be achieved without mechanical devices or solvents by utilizing the weight of the concrete for assuring the integrity of the splice.

An application of the invention will be described in connection with a flat slab on grade having a typical 6 in. (15.2 cms.) depth. Initially, a subgrade 26 is dressed to provide a smooth, flat horizontal support surface. The perimeter of the slab is defined and conventional side forms 28 are erected. The relief form 10 is then tailored for accommodation within the confines of the side forms 28. This may require cutting a typical 4 ft. by 8 ft. base sheet or trimming sections from an additional base sheet and placing same in an overlapping fashion, as shown in FIG. 6, so as to provide a continuance of coverage between the side forms 28.

The reinforcing mesh 26 is typically a network of orthogonal steel rods and an individual rod can be snugly inserted between the tabs 22. In this regard, it should be noted that the center-to-center spacing between the convex surfaces 14 is preferably 12 in. (30.5 cms.) for compatibility with the standard wire mesh. The maximum diameter of the void spaces 16 in this embodiment is 8 in. (20.3 cms.).

The spacer nodules 20 offset the under-surface 18 from the dressed subgrade 26 and provide for drainage or water runoff.

It should also be noted that the arrangement of the dome-shaped voids 14 provide sufficient clearance therebetween to accommodate a worker's foot during installation of the reinforcement mesh 24 and pouring of a concrete mass 30. Furthermore, the reinforcement mesh 24 will be firmly positioned at the design depth below the concrete, preferably 1 in. (2.5 cms.).

After the concrete 30 is poured, the bubble relief form becomes an integral element in the completed structure. The water impervious characteristics of the base member 12 advantageously prevents water seepage from the concrete 30 to the surrounding subgrade 26 and thus enhances the curing procedure. Additionally, air pockets within the void spaces 16, provide a thermal insulation system.

Thus, it will be seen that there is provided a bubble relief form which achieves the various objects of the invention and which is well adapted to meet conditions of practical use.

Since various possible embodiments might be made of the present invention or variant changes might be made in the exemplary embodiment set forth, it is to be understood that all materials shown and described in the accompanying drawings are to be illustrative and not in a limiting sense.

Having thus described the invention, there is claimed as new and desired to be secured by Letters Patent:

1. A modular bubble relief form adapted for incorporation within a concrete slab on grade comprising a substantially planar base member of light-weight, water impervious, thermoplastic material, said base member being conformably positionable on a subgrade for accommodatingly confining concrete in a plastic state for controlled curing, said base member further including a matrix of convex relief areas in an uppersurface of the base member defining a reinforcement support plane said convex relief areas further controlling flow distribution of the concrete, seating means including integral tab elements within the reinforcement support plane for snugly receiving a concrete reinforcement member, an undersurface of said base member defining concave void spaces corresponding to the respective relief areas, said void spaces providing a reduction of the concrete volume and air insulation pockets for the concrete slab when the undersurface is in confronting relationship with the subgrade and a plurality of uniform spacer nodules projecting from the undersurface of the base member, said nodules providing displacement of the concrete slab from the subgrade for ground water drainage.

2. A bubble reflief form for a concrete slab as claimed in claim 1 wherein the relief areas defined a pattern of dome-shaped curvatures said curvatures further being spaced apart so as to provide work clearance therebetween for facilitating installation of the reinforcement members and pouring of the concrete.

3. A bubble relief form for a concrete slab as claimed in claim 2 wherein the tab members lie within a horizontal plane being substantially tangent to the dome-shaped curvatures.

4. A bubble relief form for a concrete slab as claimed in claim 1 wherein the tab elements are arranged upon the upper surface of each relief area and are adapted to receive orthogonal mesh reinforcement.

5. A bubble relief form for a concrete slab as claimed in claim 1 wherein the relief areas are spaced a distance of 12 inches between centers.

6. A bubble relief form in combination with a concrete slab comprising a substantially planar base member adapted for placement on a subgrade, said base member including a matrix of convex relief areas in an uppersurface, seating means including tab elements projecting from said relief areas, a plurality of concrete reinforcement members, said tab elements being adapted for snuggly engaging said reinforcement members, a uniform thickness of concrete positioned on the uppersurface, said concrete being in communication with the reinforcement members and conforming to the relief areas, said base member further defining an undersurface including concave void spaces corresponding to the respective relief areas, said void spaces providing air insulation pockets between the undersurface and the subgrade, a plurality of spacer nodules extending from the undersurface of the base member, said nodules being adapted for displacing the undersurface from the subgrade for ground water drainage.

* * * * *